US007156066B2

(12) United States Patent
Nishizawa

(10) Patent No.: US 7,156,066 B2
(45) Date of Patent: Jan. 2, 2007

(54) AIR INTAKE DEVICE FOR ENGINE

(75) Inventor: Kazuya Nishizawa, Shizuoka-ken (JP)

(73) Assignee: Yamaha Motor Co., Ltd., Shizuoka (JP)

( * ) Notice: Subject to any disclaimer, the term of this patent is extended or adjusted under 35 U.S.C. 154(b) by 0 days.

(21) Appl. No.: 11/062,995

(22) Filed: Feb. 22, 2005

(65) Prior Publication Data

US 2005/0183690 A1 Aug. 25, 2005

(30) Foreign Application Priority Data

Feb. 20, 2004 (JP) ..... 2004-044028

(51) Int. Cl.
*B60K 13/02* (2006.01)

(52) U.S. Cl. ..... 123/198 E; 123/184.21

(58) Field of Classification Search ..... 123/198 E, 123/184.21, 184.61
See application file for complete search history.

(56) References Cited

U.S. PATENT DOCUMENTS 4,897,097 A * 1/1990 Yamamura ..... 55/419
5,120,334 A * 6/1992 Cooper ..... 96/422
5,524,585 A * 6/1996 Conoscenti ..... 123/198 E
5,553,587 A * 9/1996 Conoscenti ..... 123/198 E
6,251,151 B1 * 6/2001 Kobayashi et al. ..... 55/309
6,423,108 B1 * 7/2002 Mueller ..... 55/385.3
6,510,832 B1 * 1/2003 Maurer et al. ..... 123/198 E
6,564,768 B1 * 5/2003 Bauer et al. ..... 123/198 E
6,705,272 B1 * 3/2004 Leipelt et al. ..... 123/198 E
6,726,737 B1 * 4/2004 Schorn ..... 55/385.3
2002/0078916 A1 * 6/2002 Altmann et al. ..... 123/184.21
2002/0083916 A1 * 7/2002 Maurer et al. ..... 123/198 E

FOREIGN PATENT DOCUMENTS

JP 2002-364467 A 12/2002

* cited by examiner

*Primary Examiner*—Stephen K. Cronin
*Assistant Examiner*—Jason Benton
(74) *Attorney, Agent, or Firm*—Knobbe, Martens, Olson & Bear, LLP

(57) ABSTRACT

An air intake device for an engine has a cleaner element. A housing encloses the cleaner element. The housing communicates with the engine downstream of the cleaner element. The housing has an intake section disposed upstream of the cleaner element. The intake section defines an air passage that has a plurality of inlet openings through which ambient air is introduced into the air passage. The inlet openings communicate with each other upstream of the cleaner element. The cleaner element faces the air passage.

23 Claims, 5 Drawing Sheets

AIR INTAKE DEVICE FOR ENGINE

PRIORITY INFORMATION

This application is based on and claims priority to Japanese Patent Application No. 2004-044028, filed Feb. 20, 2004, the entire contents of which is hereby expressly incorporated by reference.

BACKGROUND OF THE INVENTIONS

1. Field of the Inventions

The present inventions generally relate to an air intake device for an engine, and more particularly to an air intake device that introduces ambient air to an engine.

2. Description of the Related Art

Typically, vehicles such as, for example, automobiles and motorcycles have an engine that powers drive wheels. An air intake device introduces or guides ambient air to the engine. The air intake device can house a cleaner element, also referred to as a filter. Such an air intake device usually has an inlet opening upstream of the filter and an outlet opening downstream of the filter. The outlet opening is coupled with the engine.

During operation, the ambient air enters the intake device through the inlet opening, passes through the filter and goes to the engine through the outlet opening. Negative intake pressure generated in the engine pulls the air through the intake device and the filter. The filter removes foreign substances from the air.

Generally, such an intake device is designed such that an internal air passage defined therein has a relatively large cross-sectional area. This reduces a pressure loss caused by the intake device and thus allows air to flow quickly to the engine. As a result, engine performance, particularly acceleration performance, can be greatly improved.

Conventionally, many different intake devices have been used. For example, Japanese Patent Publication No. P2002 364467A discloses one of such intake devices.

Conventional intake devices, however, are likely to be bulky if a large cross-sectional area is provided therein. Generally, motorcycles have a less space available for the intake device compared to automobiles. This is because the motorcycles typically have a seat which the rider straddles. Usually, the intake device is disposed in front of the seat and in a relatively narrow space in which, for example, the engine and a fuel tank are placed. The engine and the fuel tank are large enough to almost occupy the entire space.

SUMMARY OF THE INVENTIONS

An aspect of at least one of the embodiments involves the recognition of the need for an improved intake device that does not need a large space to obtain a relatively large cross-sectional area for an internal passage thereof.

To address such a need, one embodiment involves an air intake device for an engine comprising a cleaner element. A housing is configured to enclose the cleaner element. The housing is adapted to communicate with the engine downstream of the cleaner element. The housing comprises an intake section disposed upstream of the cleaner element. The intake section defines an air passage that has a plurality of inlet openings through which ambient air is introduced into the air passage. The inlet openings communicate with each other upstream of the cleaner element. The cleaner element faces the air passage.

In accordance with another embodiment, an air intake device for an engine comprises a cleaner element. A housing is configured to enclose the cleaner element. The housing comprises first, second and third sections. The first section is disposed upstream of the cleaner element. The first section defines at least two inlet openings through which ambient air is introduced into the first section. The second section holds the cleaner element. The at least two inlet openings communicate with each other upstream of the cleaner element. The third section is adapted to be connected to the engine downstream of the cleaner element. The air is movable to the third section from the first section through the cleaner element in the second section.

BRIEF DESCRIPTION OF THE DRAWINGS

These and other features, aspects and advantages of the present inventions are described below with reference to the drawings of preferred embodiments, which are intended to illustrate and not to limit the present inventions. The drawings comprise five figures in which.

DETAILED DESCRIPTION OF THE PREFERRED EMBODIMENTS

With reference to FIGS. 1–5, an air intake device 30 is configured and arranged for an internal combustion engine 32 of a motorcycle 34 in accordance with certain features, aspects and advantages of the present embodiment. The intake device 30 has particular utility in the context of an engine of a motorcycle, and thus is described in this context. The intake device 30, however, can be used for any type of engine that power vehicles such as, for example, automobiles, marine vehicles, or any stationary machines other than vehicles. Such applications are apparent to those of ordinary skill in the art in light of the description herein.

Figure 1:
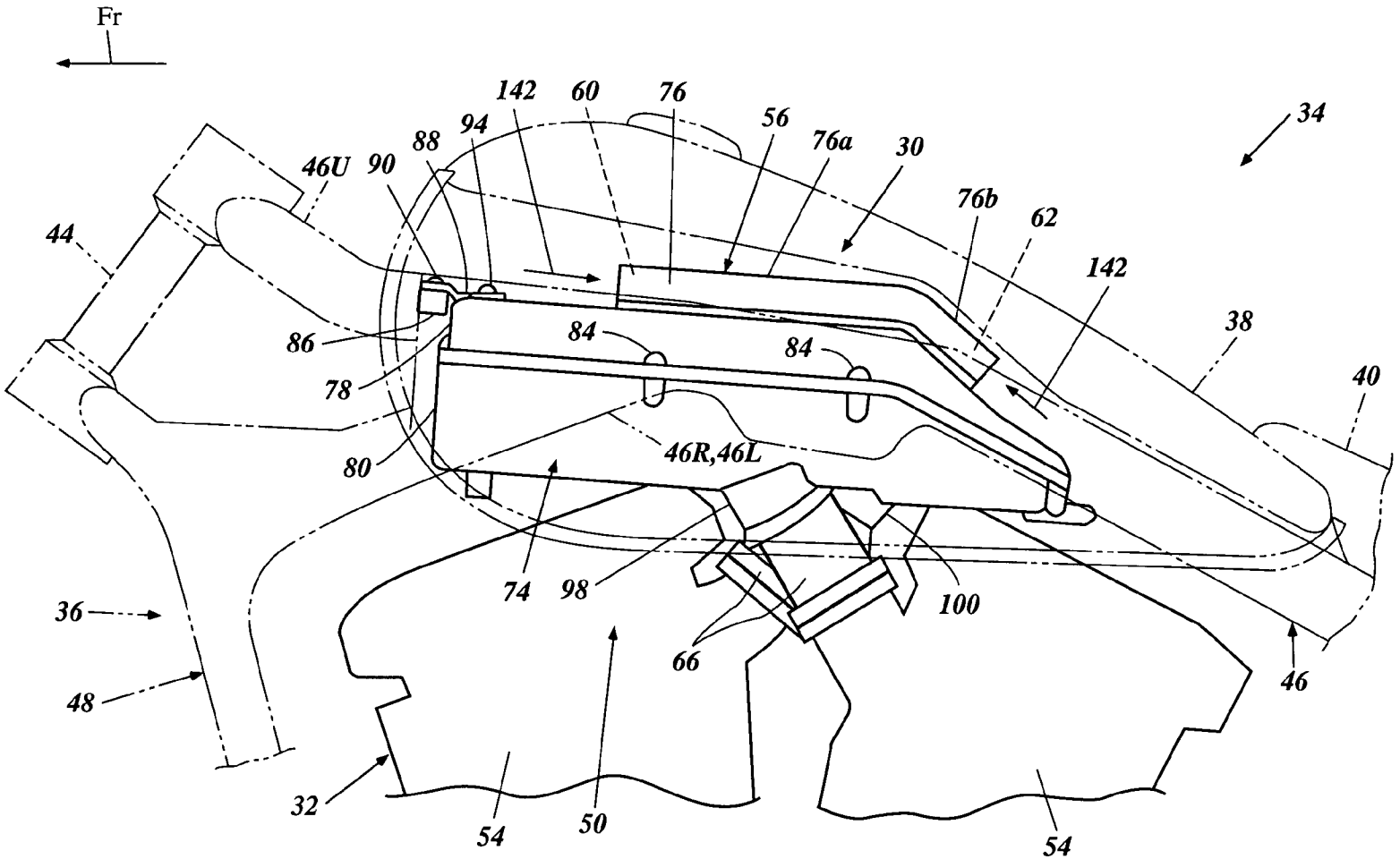
FIG. 1 is a side elevational view of a portion of a motorcycle engine and an air intake device configured and arranged in accordance with an embodiment, wherein the motorcycle frame, fuel tank, and the engine are partially shown in phantom.
Figure 2:
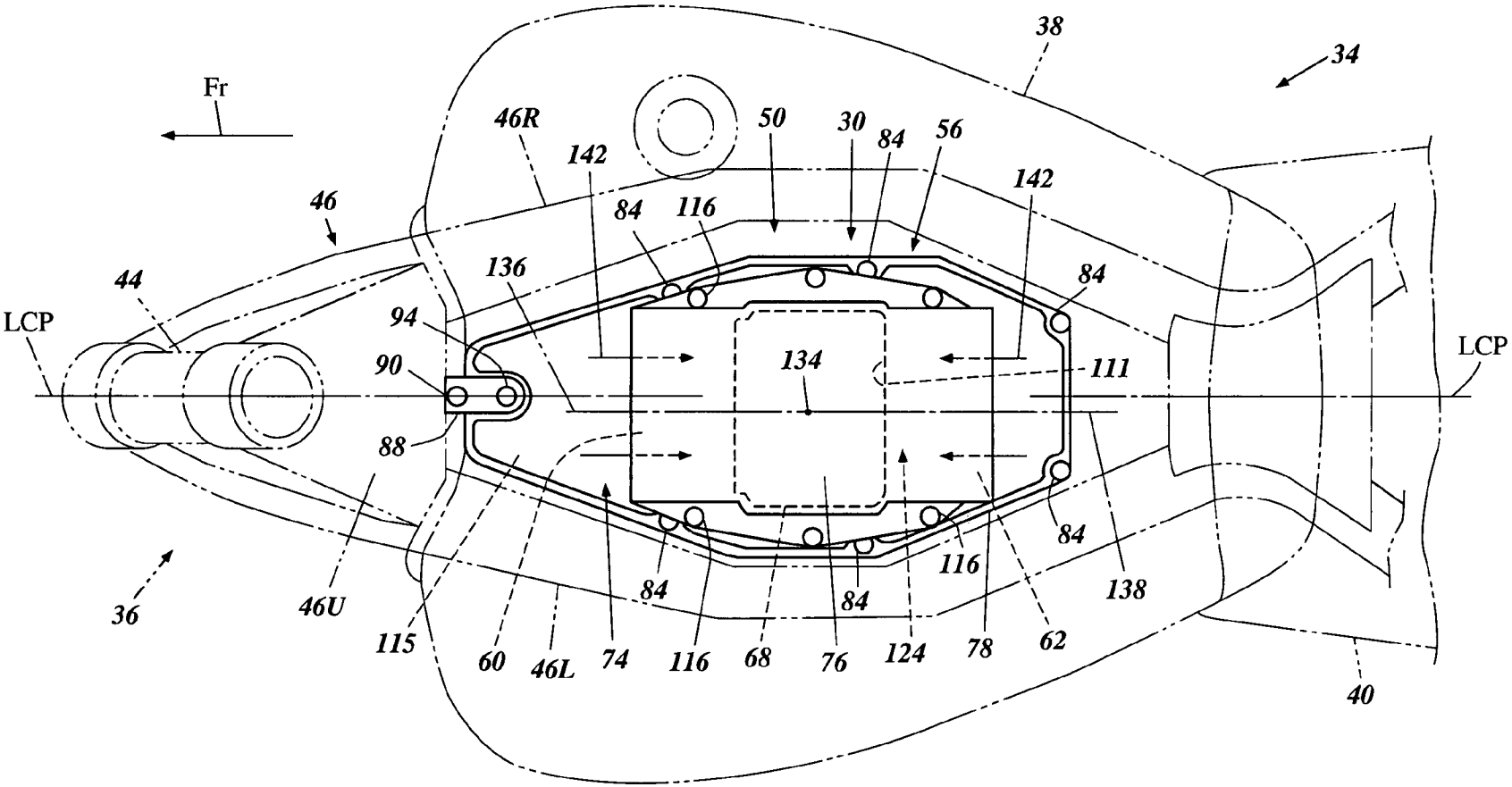
FIG. 2 is a top plan view of the air intake device of FIG. 1, wherein the motorcycle frame and fuel tank are shown in phantom.
Figure 3:
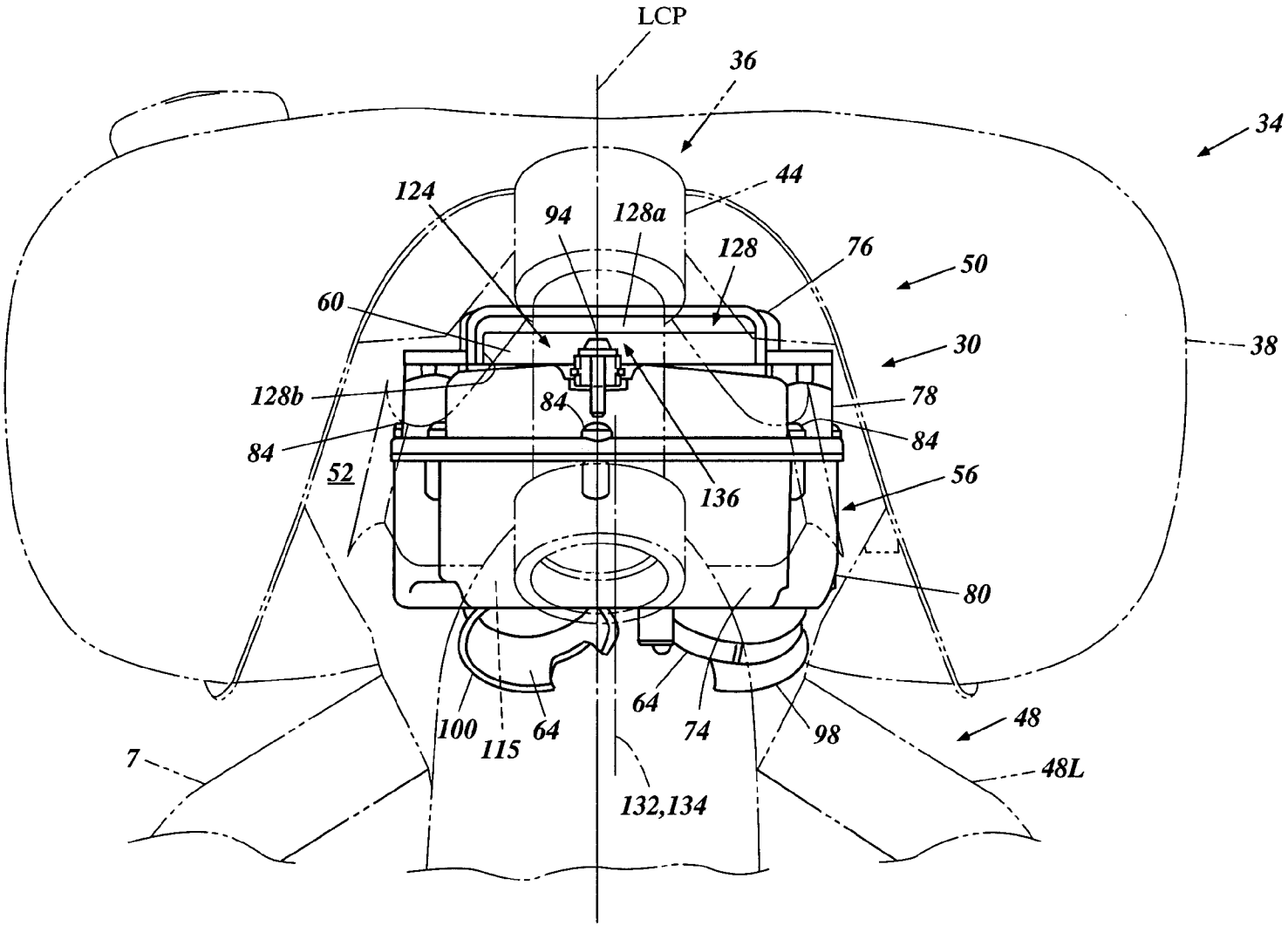
FIG. 3 is a front elevational view of the air intake device of FIG. 1, wherein the motorcycle frame, fuel tank, and engine are shown in phantom.

With reference to FIGS. 1–3, the motorcycle 34 is one type of vehicle which a rider straddles to drive the vehicle. The illustrated motorcycle 34 comprises a frame assembly 36, a fuel tank 38, a seat 40, and the foregoing engine 32.

The frame assembly 36 generally is constructed with pipes or other members. The illustrated frame assembly 36 comprises a head pipe 44, a main frame 46, a down tube 48, a seat rail (not shown) and other frame components.

The head pipe 44 is generally positioned at a leading end of the motorcycle 34 when the motorcycle 34 moves forwardly. An axis of the head pipe 44 preferably extends along the longitudinal center plane LCP of the motorcycle 34 (FIG. 2). The longitudinal center plane LCP extends vertically and fore to aft along the center of the motorcycle 34. In other words, the motorcycle 34 is generally symmetrical relative to the longitudinal center plane LCP. However, those of ordinary skill in the art understand that many components of a motorcycle are not precisely symmetrically disposed, such as rear suspension components, transmissions, and other components.

The head pipe 44 preferably journals a steering shaft of a front fork for a pivotal movement. The steering shaft preferably carries a pair of fork members. The fork members interpose a front wheel therebetween. Also, the steering shaft preferably carries a handle bar at a top thereof. The rider can steer the front fork with the handle bar. Also, a throttle lever is preferably provided at the handle bar. The throttle lever is connected to a throttle device in an intake system 50 of the engine 32. The rider can accelerate the engine operation with the throttle lever.

As used through this description, the terms "forward" and "front" mean at or toward the side where the head pipe 44 is positioned, and the terms "rear" and "rearward" mean at or toward the opposite side of the front side, unless indicated otherwise or otherwise readily apparent from the context use. The arrows Fr indicate the front side of the motorcycle 34. Also, as used in this description, the term "horizontally" means that the subject portions, members or components extend generally parallel to the ground when the motorcycle 34 stands normally on a horizontal area of the ground. The term "vertically" means that portions, members or components extend generally normal to those that extend horizontally.

With reference to FIG. 1, in the illustrated embodiment, a single upper member 46U extends rearwardly and downwardly from a top end of the head pipe 44. Also, a lower member extends from a bottom end of the head pipe 44. The lower member branches off to form a pair of upper portions 46R, 46L and a pair of lower portions. The single upper member 46U is merged with the upper portions 46R, 46L to form the main frame 46 together with the upper portions 46R, 46L. Preferably, the upper member 46U is welded to the upper portions 46R, 46L. The lower portions extend downward and further rearward to form the down tube 48.

As shown in FIG. 1, the upper portions 46R, 46L of the main frame 46 extend generally horizontally rearwardly and further extends downwardly and rearwardly. Also, as shown in FIG. 2, the upper portions 46R, 46L of the main frame 46 are enlarged in portions disposed rearwardly from their forward ends and then are narrowed toward their rear ends. That is, the upper portions 46R, 46L are most spaced apart from each other in a mid portion of the main frame 46.

The main frame 46 preferably supports the fuel tank 38 and a forward end of the seat 40. The down tubes 48 preferably extend generally below the main frame 46 and support the engine 32 together with the main frame 46. That is, the engine 32 is mounted on the frame assembly 36 and specifically is disposed between the main frame 46 and the down tube 48. The seat rails preferably extend rearward from the respective upper portions 46R, 46L of the main frames 46 to support the seat 40.

The fuel tank 38 preferably is disposed between the head pipe 44 and the seat 40 and is affixed to the upper portions 46R, 46L of the main frame 46. As shown in FIG. 3, the fuel tank 38 preferably has a pair of tank chambers that are disposed generally symmetrically on both sides of the longitudinal center plane LCP. The tank chambers are connected with each other. A space 52 is formed between the tank chambers as shown in FIG. 3. The fuel tank 38 contains fuel that is supplied to the engine 32 for combustion therein.

The seat 40 is disposed at the rear of the fuel tank 38. The rider can straddle the seat 40. Generally, below the seat 40 and in the rear of the engine 32, the frame assembly 36 rotatably supports a rear wheel (not shown). The rear wheel preferably is a propulsive wheel of the motorcycle 34. The motive power of the engine 32 is transmitted to the rear wheel via a suitable transmission system (not shown).

The engine 32 can be a multi-cylinder, four stroke engine. The engine 32, however, merely exemplifies one type of engine that can be used. Other types of engines such as, for example, single cylinder, two stroke engines can be used.

The engine 32 can include a cylinder block and a crankcase. The illustrated cylinder block is bifurcated upwardly from the crankcase to form two cylinder banks 54 extending in a V configuration. The banks 54 are disposed fore to aft along the longitudinal center plane LCP of the motorcycle 34.

Each bank 54 of the cylinder block defines at least one cylinder bore. A piston is reciprocally disposed in each cylinder bore. A cylinder head assembly closes one end of each cylinder bore. The piston and the cylinder head assembly together define a combustion chamber within the cylinder bore. The crankcase closes another end of each cylinder bore and journals a crankshaft therein. The respective pistons are connected to the crankshaft through respective connecting rods. Thus, the crankshaft rotates with the reciprocal movement of the pistons.

Ambient air is introduced into the combustion chambers through the intake system 50. The intake system 50 includes the air intake device 30. The intake device 30 preferably has a housing unit 56 that is placed at the most upstream position in the intake system. The housing unit 56 is disposed in the space 52 defined by the fuel tank 38 and is affixed to the main frame 46.

Figure 4:
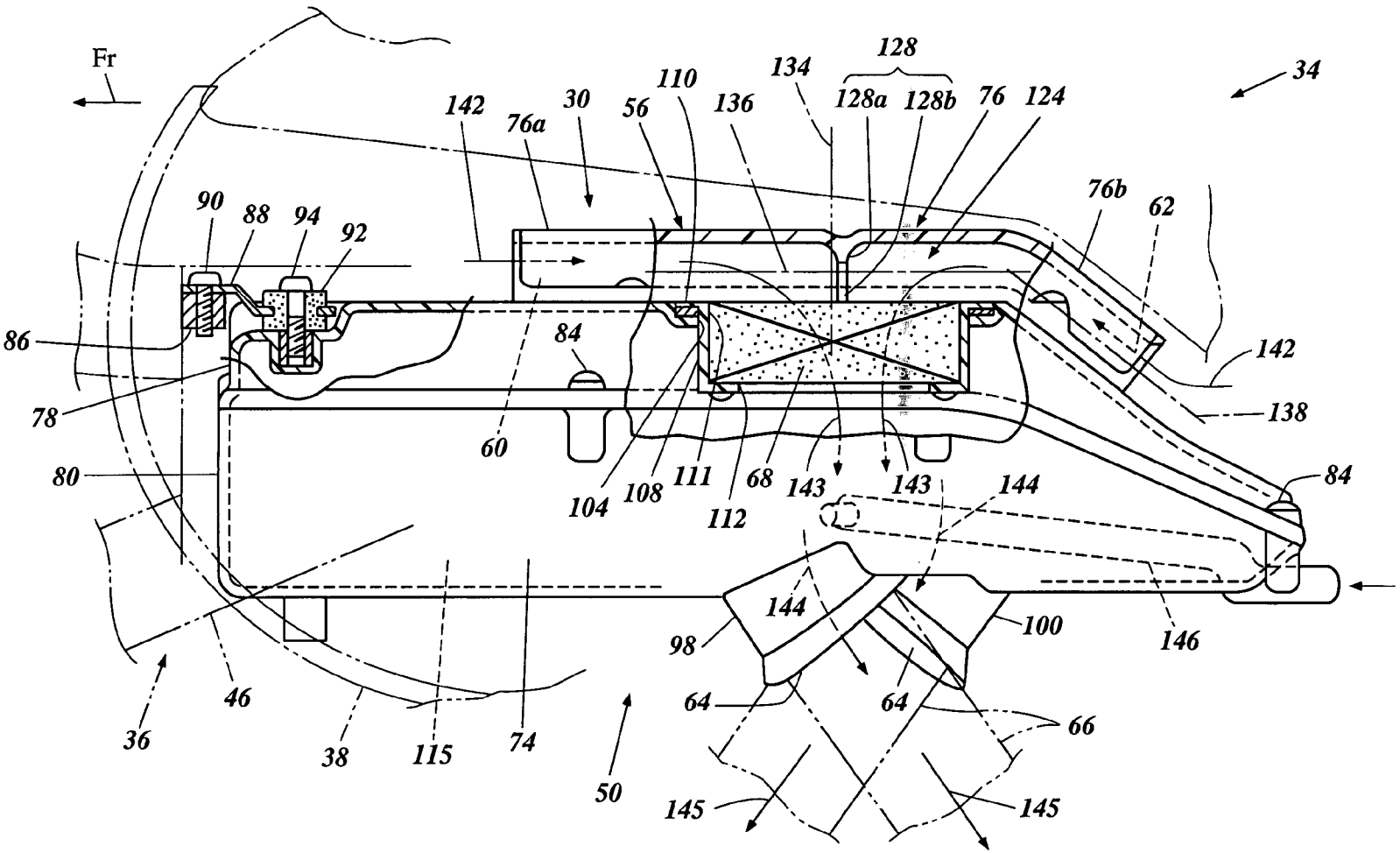
FIG. 4 is an enlarged side elevational view of the air intake device of FIG. 1, wherein the intake device is shown partially in cross-section and a part of the motorcycle is shown in phantom.

As shown in FIG. 4, the housing unit 56 in the illustrated embodiment defines a forward inlet opening 60, a rear inlet opening 62 and two outlet openings 64. The outlet openings 64 preferably are formed at a lower portion of the housing unit 56. Intake ducts 66 preferably extend downward from the respective outlet openings 64. Each intake duct 66 can be connected to a respective bank 54 such that its internal passage communicates with an inner intake passage of the bank 54. The inner intake passage communicates with the combustion chamber.

The housing unit 56 preferably also contains a cleaner element 68 disposed between the inlet openings 60, 62 and the outlet openings 64 such that air from the inlet openings 60, 62 passes through the cleaner element 68 before reaching the outlet openings 64.

The ambient air is drawn into the housing unit 56 through the inlet openings 60, 62 by the negative pressure generated in each combustion chamber when each piston moves downwardly within the cylinder bore to increase a volume of the combustion chamber. The air moves through the housing unit 56 and exits through the outlet openings 64. The air further moves through each intake duct 66 and the associated inner intake passage of the bank 54 and finally reaches the combustion chamber of each bank 54. The cleaner element 68 can remove foreign substances such as, for example, dust or water mist while the air passes through the cleaner element 68.

A throttle valve can be pivotally disposed within each intake duct 66. Such a throttle valve can be configured to regulate an amount of the air that is introduced into each combustion chamber in response to a position of the throttle valve. The rider can control the position of the throttle valve by the throttle lever on the handle bar.

The fuel in the fuel tank 38 can be delivered to each combustion chamber in accordance with the amount of the air. Preferably, one or more carburetors or fuel injectors are provided to deliver the fuel. The carburetors or the fuel injectors can be disposed on the intake ducts 66. Thus, an air/fuel charge can be formed within each combustion chamber.

An ignition device preferably ignites the air/fuel charge in each combustion chamber at a suitable moment. The air/fuel charge thus is burned. The burnt charge, i.e., exhaust gases, are discharged out of the combustion chambers preferably through an exhaust system (not shown).

With continued reference to FIGS. 1–3 and with additional reference to FIGS. 4 and 5, the air intake device 30 is described in greater detail below.

The housing unit 56 of the intake device 30 preferably comprises a main housing 74 and a sub housing (or intake section 76). Both of the main and sub housings 74, 76 preferably are made of a plastic material. The illustrated main housing 74 comprises an upper housing member 78 and a lower housing member 80. Preferably, the upper and lower housing members 78, 80 are detachably coupled with each other by bolts 84. Alternatively, the main housing 74 can be made in unison.

A stay 86 (FIG. 1) preferably extends rearwardly from a rear end of the single upper member of the main frame 46. The illustrated stay 86 is a projection that is unitarily formed with the single upper member 46U. A separate stay can be affixed to the main frame 46 in another variation.

A bracket 88 preferably extends rearward from the stay 86. The illustrated bracket 88 is affixed to the stay 86 by a bolt 90. The bracket 88 has a grommet 92 on a rear end of the bracket 88. Another bolt 94 preferably extends through the grommet 92 to fix a forward end of the upper housing member 78 to the bracket 88. The housing unit 56 has a bolt hole 96 (FIG. 5) to receive the bolt 94. The main frame 46 thus supports the forward end of the housing unit 56.

In the illustrated embodiment, a forward duct 98 and a rearward duct 100 preferably extend from a bottom surface of the lower housing member 80. Preferably, the ducts 98, 100 are relatively short. The forward duct 98 preferably inclines rearwardly and defines one of the outlet openings 64. The rear duct 100 preferably inclines forwardly and has another outlet opening 64. The forward duct 98 is connected to one of the intake ducts 66 that belongs to the rear bank 54. The rear duct 100 is connected to another intake duct 66 that belongs to the front bank 54. As thus constructed, the respective banks 54 support a mid portion of the housing 56 via the intake ducts 66.

The main housing 74 can be configured as a polyhedron that generally extends along the main flame 46. That is, the main housing 74 is elongated along the longitudinal center plane LCP of the motorcycle 34. As shown in FIGS. 1 and 4, a top surface of the main housing 74 can extend generally horizontally and can further extend obliquely downwardly and rearwardly toward a rear end portion thereof. Also, as shown in FIGS. 2 and 5, side surfaces of the main housing 74 are enlarged rearwardly from its front end and then extend generally parallel to each other. Further, the side surfaces are narrowed toward its end. The main housing 74 preferably defines a relatively large internal cavity.

As shown in FIG. 4, the main housing 74 preferably also defines an opening 104 in its top surface. The opening 104 preferably has a rectangular shape. A surrounding area of the main housing 74 that surrounds the opening 104 is slightly lowered to form a step.

An element holder (or element holding section) 108 is preferably fitted into the opening 104. The illustrated element holder 108 has a top end 110 that turns outwardly. The element holder 108 thus can hang down with its top end 110 being hooked by the surrounding area of the main housing 74. The top end 110 thus defines an inlet opening 111 that is directed upwardly. Preferably, a top surface of the top end 110 is about flush with the top surface of the main housing 74.

The element holder 108 preferably defines an outlet opening 112 in its bottom surface. The element holder 108 can enclose the cleaner element 68 therein. The cleaner element 68 can be a filter that allows air to pass therethrough but inhibits foreign substances from passing therethrough. The internal cavity of the main housing 74 except for the volume of the cleaner element 68 remains as a plenum chamber 115.

The sub housing (i.e., intake section) 76 can entirely cover a top surface of the cleaner element 68. The illustrated sub housing 76 can be detachably affixed to the top surface of the main housing 74 by bolts 116.

Figure 5:
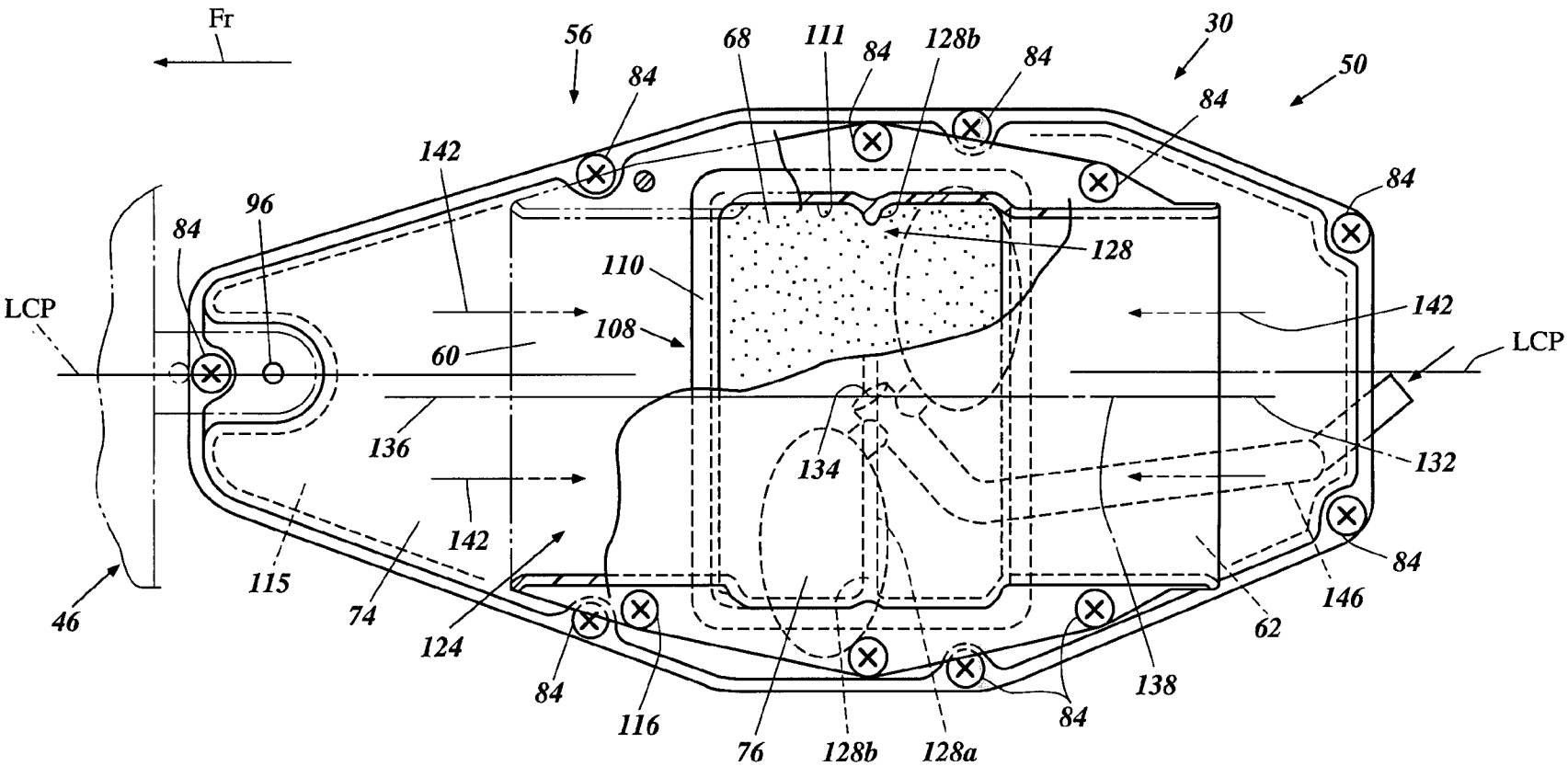
FIG. 5 is an enlarged top plan view of the air intake device of FIG. 1.

As shown in FIGS. 2 and 5, the sub housing 76 is generally shaped as a rectangular parallelepiped in a top plan view except for two flanges extending on both sides thereof to form bolt holes for the bolts 116. Also, as shown in FIGS. 1 and 4, the sub housing 76 preferably extends generally horizontally along the top surface of the main housing 74 and further obliquely extends downwardly rearwardly along the rear end portion of the main housing 74. That is, the sub housing 76 is elongated along the main housing 74 and has a horizontally extending portion 76*a* and an obliquely extending portion 76*b*.

The sub housing 76 preferably has an internal cavity that is smaller than the cavity of the main housing 74. The sub housing 76 preferably defines the forward inlet opening 60 at its front end of the horizontally extending portion 76*a* and the rear inlet opening 62 at its rear end of the obliquely extending portion 76*b* to define an air passage 124 in the internal cavity and between the forward and rear inlet openings 60, 62. The first and second inlet openings 60, 62 communicate each other through the air passage 124. The forward and rear inlet openings 60, 62 communicate with each other upstream of the cleaner element 68. The cleaner element 68 faces the air passage 124 through the inlet opening 111 of the element holder 108. The element holder 108 is preferably spaced apart from any one of the inlet openings 60, 62.

With reference to FIGS. 3–5, the sub housing 76 preferably has a guide projection 128 that extends from an internal surface of the sub housing 76 into the air passage 124. The guide projection 128 inhibits the air in the air passage 124 from going straight through the subhousing 76 and redirects the air toward the cleaner element 68 disposed below the sub housing 76. In other words, the guide projection 128 guides the air flow in the air passage 124 to the cleaner element 68.

The guide projection 128 preferably comprises a transverse portion 128*a* and side portions 128*b*. Preferably, the transverse portion 128*a* extends transversely and vertically downwardly from the roof of the air passage 124, while the side portions 128*b* contiguously and vertically extend from the transverse portion on both sides of the air passage 124. Thus, the air that flows generally horizontally in the air passage 124 is directed to the cleaner element 68 when the air hits against the guide projection 128.

Additionally, the illustrated sub housing 76 has relatively large stiffness because the transverse portion 128*a* and the side portions 128*b* of the guide projection 128 reinforce the top surface and side surfaces of the sub housing 76. In an alternative construction, however, either the transverse portion 128*a* or the side portions 128*b* can be omitted. In another alternative, one of the side portions 128*b* can be omitted such that only one side portion 128*b* exists.

With reference to FIG. 5, a longitudinal center plane 132 that extends vertically and longitudinally in the center of the sub housing 76 is disposed slightly toward the left side relative to the longitudinal center plane LCP of the motorcycle 34. The longitudinal center plane 132 of the sub housing 76, however, can be co-planar with the longitudinal center plane LCP of the motorcycle 34, or offset toward the right side of the plane LCP. A vertical center axis 134 of the inlet opening 111 of the element holder 108 preferably straddles the longitudinal center plane 132.

The sub housing 76 thus has a configuration such that the obliquely extending portion 76*b* is bent in the longitudinal center plane 132 and the center axis 134 of the element holder 108 extends through the center plane 132. Accordingly, the entire configuration of the housing unit 56 is quite simple. This configuration particularly contributes to a production of the housing unit 56. That is, a production manner using a plurality of molds can be easier.

The major part of the air in the air passage 124 can enter the cleaner element 68 by the guidance of the guide projection 128 because the engine 32 pulls the air therethrough. However, some of the air may go to the other inlet opening 60, 62 against the guidance of the guide projection 128 due to its inertia. The illustrated sub housing 76 does not let the air escape because of the horizontally extending portion 76*a* and the obliquely extending portion 76*b*.

More specifically, the longitudinal center plane 132 preferably includes a horizontally extending center axis 136 and an obliquely extending center axis 138. The center axis 136 extends horizontally in the center of the horizontally extending portion 76*a* of the sub housing 76. The center axis 138 extends obliquely downward and rearward in the obliquely extending portion 76*b* of the sub housing 76. That is, the respective center axes 136, 138 generally intersect each other with a specific angle. The angle is preferably an obtuse angle such as, for example, 135 degrees. However, other angles can also be used.

Because of this arrangement of the axes 136, 138, the air entering the air passage 124 through the forward or rear inlet opening 60, 62 does not go straight through toward the opposite inlet opening 62, 60 but inevitably hits against the roof of the air passage 124 and can thus lose at least some of its inertia. The air that has lost the inertia is easily pulled back toward the cleaner element 68 by the negative pressure in the engine 32. Particularly, the arrangement is useful to prevent the air that enters through the forward opening 60 when the motorcycle 34 travels from going out through the rear inlet opening 62.

In one variation, the respective center axes 136, 138 can be offset from one another in a transverse direction of the sub housing 76 unless the sub housing 76 becomes much longer in the transverse direction. That is, those axes 136, 138 do not need to completely intersect each other.

With reference to FIGS. 1–5, during operation of the engine 32, the ambient air enters the air passage 124 through the forward inlet opening 60 or the rear inlet opening 62 of the sub housing 76 as indicated by the arrows 142 of FIGS. 1, 2, 4 and 5 because the engine 32 pulls the air as such. The air moves toward the cleaner element 68 in the air passage 124. Because the guide projection 128 directs the air toward the cleaner element 68, the major part of the air enters the cleaner element 68 through the inlet opening 111 of the element holder 108. Some of the air can go to the other inlet opening 60, 62. The air, however, hits against the roof of the air passage 124 and is redirected back to the cleaner element 68. Thus, almost all of the air passes through the cleaner element 68 and enters the plenum chamber 115 as indicated by the arrows 143 of FIG. 4.

As air passes through the cleaner element 68, foreign substances can be removed from the air. The air accumulates in the plenum chamber 115 temporarily. This is because as the engine 32 cycles through strokes other than the intake stoke, the air slows or stops in the chamber 115. The air moves to the intake ducts 66 through the outlet openings 64 of the forward and rear ducts 98, 100 from the plenum chamber 115 as indicated by the arrows 144 of FIG. 4 when the engine 32 again pulls the air. The air then finally reaches the combustion chambers through the intake ducts 66 as indicated by the arrows 145 of FIG. 4. However, in other engines, such as those engines with more cylinders, the pulsating movement of the air through the chamber 115 can be smoother.

The volume of the plenum chamber 115 is useful because a relatively large amount of the air can be delivered to the engine 32 without excessive resistance. The engine 32 thus can provide good responsiveness to quick operations of the throttle valve by the rider. This is particularly advantageous for a motorcycle because the rider usually requires quick and frequent accelerations while driving.

The air intake device 30 can have other components or members. For example, the main housing 74 has a blow-by gas tube 146 that introduces blow-by gases into the plenum chamber 115.

The air intake device 30 in the illustrated embodiment has the sub housing 76 (i.e., intake section) upstream of the cleaner element 68. The sub housing 76 has the forward and rear inlet openings 60, 62 through which the ambient air is introduced into the air passage 124. The forward and rear inlet openings 60, 62 communicate with each other upstream of the air passage 124. The cleaner element 68 faces the air passage 124. As thus constructed, both of the forward and rear inlet openings 60, 62 can effectively introduce the ambient air into the air passage 124. In other words, the forward and rear inlet openings 60, 62 together provide a large cross-sectional area for the air passage 124 relative to the volume of the sub housing 76. The air intake device 30 thus does not need a large space to obtain such a relatively large cross-sectional area.

In general, an air intake device can generate intake noise that can disturb the rider of the vehicle. In the illustrated embodiment, the rear opening 62 that opens in front of the rider is directed downward. Such noise is not transmittable to the rider, accordingly.

In the illustrated embodiment, the sub housing 76 is smaller than the main housing 74 and elongates along the main housing 74. This configuration and arrangement further contributes to making the air intake device 30 more compact.

In addition, the illustrated housing unit 56 is formed with the sub housing 76, the upper housing member 78 and the lower housing member 80 that are coupled with one another in this order. Each housing or member 76, 78, 80 generally has a box-like shape. Thus, those housing or members 76, 78, 80 can be relatively easily formed in any production processes.

The cleaner element 68 can be previously coupled with the element holder 108. In this alternative, the element 68 and the element holder 108 together can be disposable.

The sub housing 76 can have other inlet openings. For example, such additional inlet openings can extend normal to the longitudinal center plane LCP and can open toward the upper portions 46R, 46L of the main frame 46.

Also, the sub housing 76 can take any configuration if its internal air passage can direct the air to the cleaner element without making the housing unit 56 much larger. For example, a labyrinth can be made within the air passage such that the air cannot go out through another inlet opening and rather can be directed toward the cleaner element.

Although these inventions have been disclosed in the context of a certain preferred embodiment and examples, it will be understood by those skilled in the art that the present invention extends beyond the specifically disclosed embodiment to other alternative embodiments and/or uses of the invention and obvious modifications and equivalents thereof. In addition, while several variations of the inventions have been shown and described, other modifications, which are within the scope of these inventions, will be readily apparent to those of skill in the art based upon this disclosure. It is also contemplated that various combination or sub-combinations of the specific features and aspects of the embodiments or variations may be made and still fall within the scope of the inventions. It should be understood that various features and aspects of the disclosed embodiment can be combined with or substituted for one another in order to form varying modes of the disclosed inventions. Thus, it is intended that the scope of the present inventions herein disclosed should not be limited by the particular disclosed embodiments described above.

What is claimed is:

1. An air intake device for an engine comprising a cleaner element and a housing configured to enclose the cleaner element, the housing being adapted to communicate with the engine downstream of the cleaner element, the housing being elongated along a first axis and comprising an intake section disposed upstream of the cleaner element, the intake section defining an air passage that has at least first and second inlet openings which open to the atmosphere and are configured to allow ambient air to be introduced into the air passage, the inlet openings communicating with each other upstream of the cleaner element, the cleaner element facing the air passage, the first and second inlet openings being disposed along the first axis.

2. The air intake device as set forth in claim 1, wherein the cleaner element is spaced apart from the inlet openings.

3. The air intake device as set forth in claim 2, wherein the first and second inlet openings are generally disposed on opposite sides relative to the cleaner element.

4. The air intake device as set forth in claim 3, wherein the air passage comprises a first portion and a second portion, the first portion having the first inlet opening, the second portion having the second inlet opening, the first and second portions obliquely intersecting each other.

5. The air intake device as set forth in claim 4, wherein the first portion has a first axis extending longitudinally through the first portion, the second portion having a second axis extending longitudinally through the second portion, the first and second axes generally intersecting each other.

6. The air intake device as set forth in claim 4, wherein the first portion extends generally horizontally, the second portion not extending horizontally.

7. The air intake device as set forth in claim 1, wherein the housing further comprises a main housing being elongated in one direction, the intake section being elongated along the main housing, at least the first and second inlet openings being positioned on different distal ends of the intake section.

8. The air intake device as set forth in claim 1, wherein the intake section has a guide in the air passage to direct the air toward the cleaner element during operation of the engine.

9. The air intake device as set forth in claim 8, wherein the guide is a projection extending from an internal surface of the intake section.

10. The air intake device as set forth in claim 1, wherein the housing further comprises an element holding section configured to hold the cleaner element, the holding section is spaced apart from any one of the inlet openings.

11. The air intake device as set forth in claim 10, wherein the intake section is disposed atop of the housing, the element holding section is disposed below the intake section.

12. The air intake device as set forth in claim 10, wherein an internal space of the housing except for the intake section and the element holding section defines a plenum chamber, the air moves to the plenum chamber from the air passage of the intake section through the cleaner element.

13. The air intake device as set forth in claim 12, wherein the plenum chamber has an outlet opening through which the air moves to the engine.

14. An air intake device for an engine comprising a cleaner element and a housing configured to enclose the cleaner element, the housing being elongated along a fist axis and comprising first, second and third sections, the first section disposed upstream of the cleaner element, the first section defining at least first and second inlet openings which open to the atmosphere thereby allowing ambient air to be introduced into the first section, the second section holding the cleaner element, the first and second inlet openings facing opposite directions along the first axis and communicating with each other upstream of the cleaner element, the third section adapted to be connected to the engine downstream of the cleaner element, the air being movable to the third section from the first section through the cleaner element in the second section.

15. The air intake device as set forth in claim 14, wherein the second section is spaced apart from any one of the inlet openings.

16. The air intake device as set forth in claim 14, wherein the first and second inlet openings are generally disposed on opposite sides relative to the cleaner element.

17. The air intake device as set forth in claim 14, wherein the first section has an internal projection to compulsively direct the air to the cleaner element.

18. A vehicle comprising a seat for a rider, the seat being configured for a rider to straddle the seat, an engine configured to power the vehicle, and an air intake device arranged to guide air to the engine, the air intake device being disposed in front of the seat, the air intake device comprising a cleaner element and a housing configured to enclose the cleaner element, the housing communicating with the engine downstream of the cleaner element, the housing comprising an intake section disposed upstream of the cleaner element, the intake section defining an air passage that has at least first and second inlet ports through which ambient air is introduced into the air passage, the first and second inlet ports communicating with each other upstream of the cleaner element, the first inlet port facing toward a front of the vehicle and the second inlet port facing toward a rear of the vehicle.

19. The vehicle as set forth in claim 18, wherein the first inlet port is arranged to open toward the seat, and the second inlet port is directed generally downwardly.

20. The vehicle as set forth in claim 18, wherein the air intake device extends generally fore to aft of the vehicle.

21. The vehicle as set forth in claim 18, wherein the first and second inlet ports are generally disposed on opposite sides relative to the cleaner element, the first inlet port being arranged to open toward the seat.

22. The vehicle as set forth in claim 21, wherein the first port is generally directed downwardly.

23. The air intake device as set forth in claim 1, wherein the first and second inlet openings face opposite directions along the first axis.

* * * * *

UNITED STATES PATENT AND TRADEMARK OFFICE

CERTIFICATE OF CORRECTION

PATENT NO. : 7,156,066 B2
APPLICATION NO. : 11/062995
DATED : January 2, 2007
INVENTOR(S) : Kazuya Nishizawa It is certified that error appears in the above-identified patent and that said Letters Patent is hereby corrected as shown below:

In column 5, line 52, after “main” delete “flame” and insert -- frame --, therefor.

In column 10, line 29, in claim 14, delete “fist” and insert -- first --, therefor.

Signed and Sealed this

Twenty-fourth Day of February, 2009

JOHN DOLL
*Acting Director of the United States Patent and Trademark Office*